US009809753B2

(12) United States Patent
Wilborn et al.

(10) Patent No.: US 9,809,753 B2
(45) Date of Patent: Nov. 7, 2017

(54) COKE DRUM QUENCH PROCESS

(71) Applicants: Dale William Wilborn, Rolling Hills Estate, CA (US); Eileen Imelda Love, Long Beach, CA (US); Mark Anthony Alvarado, Lakewood, CA (US)

(72) Inventors: Dale William Wilborn, Rolling Hills Estate, CA (US); Eileen Imelda Love, Long Beach, CA (US); Mark Anthony Alvarado, Lakewood, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 1123 days.

(21) Appl. No.: 13/868,877

(22) Filed: Apr. 23, 2013

(65) Prior Publication Data

US 2014/0311885 A1 Oct. 23, 2014

(51) Int. Cl.
*C10B 55/00* (2006.01)
*C10B 39/06* (2006.01)
*C10G 9/00* (2006.01)

(52) U.S. Cl.
CPC ..... *C10B 39/06* (2013.01); *C10B 55/00* (2013.01); *C10G 9/005* (2013.01)

(58) Field of Classification Search
CPC ..... C10B 55/00; C10B 57/045; C10B 39/04; C10B 39/06; C10B 55/02; C10B 55/04; C10B 55/06; C10B 55/08; C10B 55/10; C10G 9/005
USPC ..... 201/39
See application file for complete search history.

(56) References Cited

U.S. PATENT DOCUMENTS 2,406,312 A * 8/1946 Barron ..... C10B 55/00 208/50
3,936,358 A * 2/1976 Little ..... C10B 39/06 201/1
4,358,343 A * 11/1982 Goedde ..... C10B 39/04 201/1
4,634,500 A * 1/1987 Elliott ..... C10B 39/06 201/39
5,024,730 A * 6/1991 Colvert ..... B01D 3/42 196/132
5,795,445 A * 8/1998 Boswell ..... C10B 39/06 201/1
2002/0134658 A1* 9/2002 Lah ..... C10B 25/10 202/245
2002/0179493 A1* 12/2002 Etter ..... C10B 55/00 208/131

(Continued)

*Primary Examiner* — Jonathan Miller
*Assistant Examiner* — Jonathan Luke Pilcher
(74) *Attorney, Agent, or Firm* — Susan M. Abernathy; Steve Roth

(57) ABSTRACT

Processes for quenching coke in a coke drum of a delayed coker unit that more thoroughly cool the coke, eliminate hot spots in the coke bed, and remove residual hydrocarbons from the coke prior to venting the coke drum may comprise a ramp quench phase and a pressure quench phase after the ramp quench phase. During the ramp quench phase, the coke drum internal pressure may rise to a maximum pressure level and then fall to a transitional pressure level. At least one control valve may be actuated at the transitional pressure level to increase the coke drum internal pressure from the transitional pressure level to a pulsed pressure level of the pressure quench phase.

23 Claims, 3 Drawing Sheets

(56) References Cited

U.S. PATENT DOCUMENTS

2008/0109107 A1* 5/2008 Stefani ..... C10L 341/00
700/207

* cited by examiner

COKE DRUM QUENCH PROCESS

FIELD

This invention relates to coke drum quench processes for a delayed coker unit.

BACKGROUND

The coking cycle of a delayed coker unit involves the thermal cracking of petroleum residua to produce gases, liquid streams of various boiling ranges, and coke. The cooling of the coke using quench water during the decoking cycle of a coke drum is a key step that occurs before unheading the drum and coke removal by drilling using high pressure cutting water. Quench water fed to the drum removes heat by vaporization, and the quench water eventually fills the drum as the coke is cooled.

Conventional quenching processes have resulted in the occurrence of "hot spots" and "blowbacks" due to inadequate cooling of the coke bed. Hot spots occur when quench water has channeled around portions of the coke bed. The presence of hot spots in the coke bed allows cutting water to contact hot coke, e.g., at about 800 F, which may result in a blowback. During a blowback, rapid vaporization of water and the subsequent pressure surge sprays coke, water and steam in multiple directions.

Such problems, resulting from poorly quenched coke drums, can cause unsafe conditions for the coke drum driller. Poor quenching can also result in coke dust community impact environmental incidents. These problems can occur during processing all forms of coke, including shot coke.

There is a continuing need for improved processes for thoroughly quenching hot coke in a coke drum of a delayed coker unit to provide improved safety during the decoking cycle, and to decrease the risk of community impact environmental incidents.

SUMMARY

In one embodiment there is provided a process for quenching coke in a coke drum of a delayed coker unit, the process comprising feeding quench water to the coke drum during an initial quench phase of the quenching process at an initial quench rate; after the step of feeding quench water to the coke drum, increasing the rate of feeding the quench water to the coke drum during a ramp quench phase of the quenching process to attain a maximum ramp quench rate, wherein during the ramp quench phase the coke drum internal pressure increases to a maximum pressure level and thereafter the coke drum internal pressure decreases to a transitional pressure level; and, at the time of the transitional pressure level, actuating at least one control valve whereby the coke drum internal pressure increases from the transitional pressure level to a pulsed pressure level.

In another embodiment there is provided a process for quenching coke in a coke drum of a delayed coker unit, the process comprising feeding quench water to the coke drum during an initial quench phase; increasing the rate of feeding the quench water to the coke drum during a ramp quench phase subsequent to the initial quench phase, wherein during the ramp quench phase the coke drum internal pressure increases to a maximum pressure level and thereafter the coke drum internal pressure decreases to a transitional pressure level; while the coke drum internal pressure is at the transitional pressure level, actuating at least one control valve to effect an increase in the coke drum internal pressure to a pulsed pressure level greater than the transitional pressure level; and after the step of actuating the at least one control valve to effect an increase in the coke drum internal pressure, actuating the at least one control valve to effect a decrease in the coke drum internal pressure from the pulsed pressure level to a vent pressure level.

In a further embodiment there is provided a process for quenching coke in a coke drum of a delayed coker unit having a blowdown system, the process comprising:

feeding quench water to the coke drum to effect cooling of the coke; during the step of feeding quench water to the coke drum, removing a first portion of hydrocarbon vapors from the coke drum to the blowdown system until a first flow of hydrocarbon vapors from the coke drum has ceased; during the step of feeding quench water to the coke drum, actuating at least one control valve to effect an increase in coke drum internal pressure; releasing a second portion of hydrocarbon vapors from the coke via the increase in coke drum internal pressure; after the step of actuating the at least one control valve to effect an increase in coke drum internal pressure, actuating the at least one control valve to effect a decrease in coke drum internal pressure; and recovering the second portion of hydrocarbon vapors from the coke drum.

DETAILED DESCRIPTION

Figure 1:
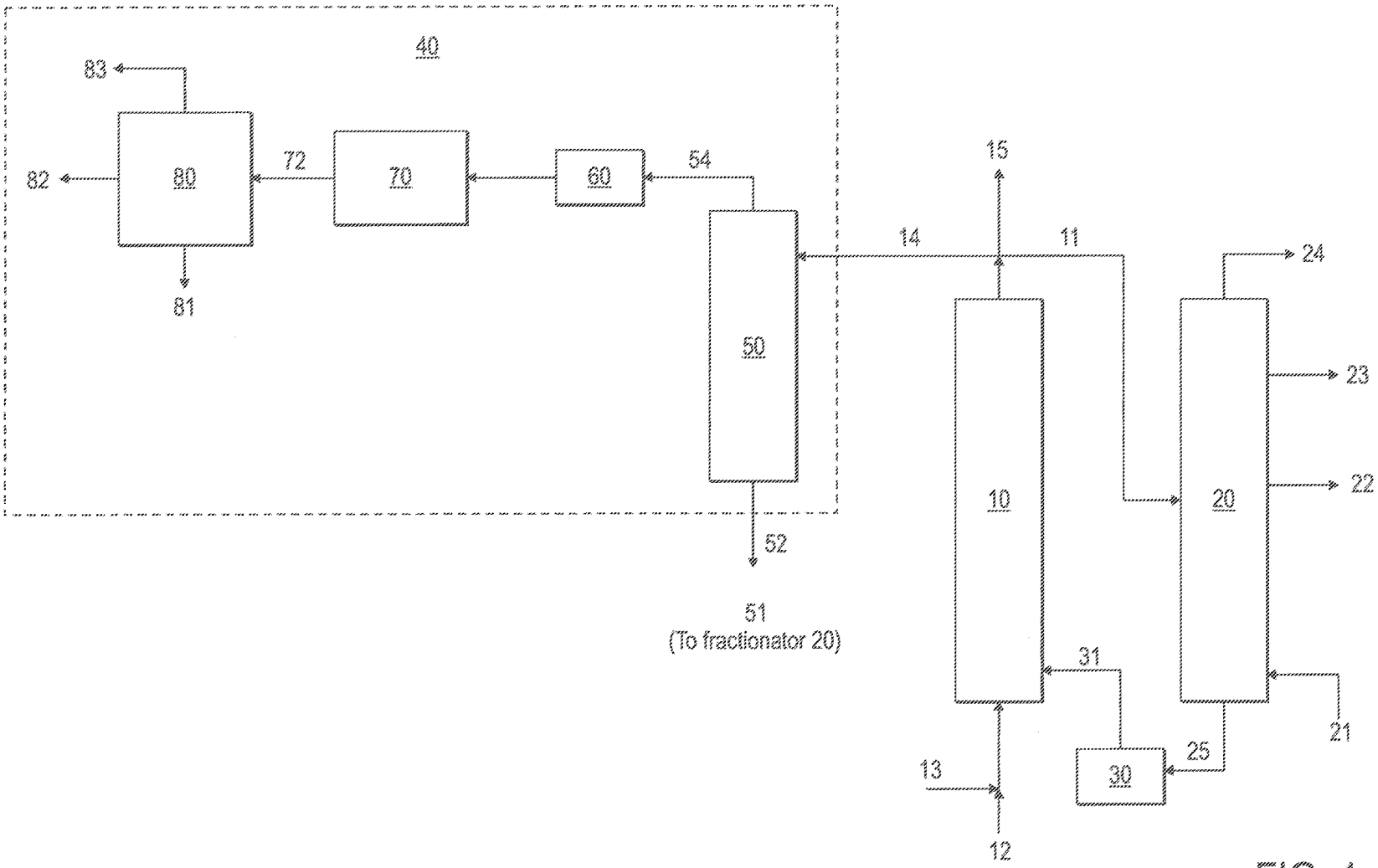
FIG. 1 is a schematic representation of a coke drum quenching process, according to an embodiment of the invention.

The present invention provides processes for more thoroughly and effectively quenching coke in a coke drum of a delayed coker unit. In an embodiment, quenching processes of the invention provide several advantages, such as increasing the safety of coke removal from the coke drum, shortening the duration of coke drum venting, and decreasing the emissions from the quenched coke drum during venting the drum.

Conventional Delayed Coking

Delayed coking involves thermal cracking of heavy liquid hydrocarbons to produce gases, liquid streams of various boiling ranges, and coke. Delayed coker units comprise a main fractionator and at least two coke drums, one of which may be used in the coking cycle and another in the decoking cycle. A feedstock for the delayed coker unit may be fed to the main fractionator for liquid surge prior to furnace and drum charge.

During the coking cycle of the delayed coking process, the coker feed from the main fractionator may be heated to coking temperature and then fed into the bottom of a first coke drum under conditions which promote thermal cracking. The heated feed in the coke drum generates volatile components that are removed overhead and passed to the main fractionator while coke accumulates in the coke drum.

The coking cycle may be continued until the first drum is filled to an appropriate level with the accumulated coke, and the furnace outlet may then be switched to a second coke drum. The decoking cycle may begin with the introduction of steam to the first drum to strip hydrocarbons from the coke. During steam stripping of the coke, the resulting mixture of steam and stripped hydrocarbons may be passed to the main fractionator for hydrocarbon recovery.

After the steam-stripping has been discontinued, the drum being decoked is switched to the blowdown system. Water may be introduced into the bottom of the coke drum to quench the coke bed. During the early stages of quenching, the quench water may be vaporized by the hot coke. The resultant steam together with hydrocarbon vapors are passed to a blowdown system for the condensation of water and oil and the separation of gases.

After the quenching process has been completed and the coke drum internal pressure has fallen to an appropriate level, the coke drum may be vented to the atmosphere prior to draining the drum and drilling the coke.

In conventional coke quenching processes, relatively large amounts of light hydrocarbons and other VOCs may be retained by the coke bed after the quench cycle has been completed, and such retained hydrocarbons and VOCs are released into the atmosphere during drum venting.

Coke Drum Quenching Processes for Increased Safety and Lower Emissions

In contrast to prior art coke drum quenching processes, processes of the present invention allow safer drilling and coke removal during the decoking cycle by eliminating hot spots during the quench cycle. In further contrast to the prior art, processes of the present invention displace residual hydrocarbons from the coke bed during the quench cycle, such that the residual hydrocarbons may be purged from the coke drum and routed to vapor recovery prior to venting the coke drum.

By displacing residual hydrocarbons and purging them from the coke drum during the quench cycle, emissions from the coke drum during venting are greatly decreased. As used herein, the term "residual hydrocarbons" refers to hydrocarbons that would remain (e.g., trapped) within the coke bed after completion of conventional coke drum quench processes, but which are released from the coke bed during coke drum quenching processes according to the present invention. Accordingly, the use of quenching processes of the invention results in much lower emissions during venting the coke drum, as compared with conventional quenching processes.

Unless otherwise specified, the recitation of a genus of elements, materials, or other components from which an individual or combination of components or structures can be selected is intended to include all possible sub-generic combinations of the listed components and mixtures thereof. Also, "include" and its variants are intended to be non-limiting, such that recitation of items in a list is not to the exclusion of other like items that may also be useful in the materials, elements, structures, and processes of this invention.

With reference to the drawings, FIG. 1 schematically represents a coke drum quenching process according to an embodiment of the invention. During the coking cycle, a heavy feedstock may be fed to the main fractionator 20 via a line 21, and then fed to a heater 30 via line 25. The heated coke drum feed may be fed from heater 30 to coke drum 10 via a coke drum feed line 31 for the production of vaporous coking products and coke. The coke accumulates in coke drum 10 while the vaporous coking products may be passed via coking product line 11 to main fractionator 20 for the separation of lighter fractions 22, 23, 24.

When the coke drum is essentially full of accumulated coke, the coking cycle may be terminated by interrupting the feed from line 31 to drum 10. Thereafter the decoking cycle may begin with the introduction of steam into coke drum 10, via steam line 12, for stripping hydrocarbons from the accumulated coke, and the stripped hydrocarbons and steam may be routed to main fractionator 20 via line 11.

After the steam stripping step, the coke drum 10 may be isolated from main fractionator 20 and depressurized to a blowdown system 40. Thereafter, the decoking cycle may continue with a quench cycle or process according to embodiments of the instant invention, wherein quench water may be introduced into coke drum 10 via a water line 13 to quench the accumulated coke. The term "quench water" as used herein may be used to refer to an aqueous quench medium and may include, for example, high water content sludge, the latter being known in the art as a quench medium for use in delayed coker units. The rate at which the quench water is fed to coke drum 10 may be controlled by a valve (not shown) on water line 13, as is known in the art.

Due to the large mass and high temperature (e.g., 750° F. to 900° F.) of the accumulated coke, initially the addition of quench water results in the formation of hot vapors comprising steam, condensable hydrocarbons, and non-condensable hydrocarbons. During the quench cycle, the overhead vapors from coke drum 10 may be passed to blowdown system 40 via a quench cycle vapor line 14. In an embodiment, blowdown system 40 may comprise a blowdown drum 50, at least one control valve 60, at least one heat exchanger 70, and at least one separator 80. A heavy oil fraction 51 may be separated from the quench cycle coke drum overhead vapors by blowdown drum 50, and the heavy oil fraction 51 may be passed to main fractionator 20 via a line 52.

The overhead vapors from blowdown drum 50 may be passed via a line 54 to heat exchanger 70 for cooling the overhead vapors. In an embodiment, heat exchanger 70 may comprise an air cooler or fin-fan system. In an embodiment (not shown), two heat exchangers may be arranged in parallel, each served by a separate line from blowdown drum 50, so as to increase the capacity of blowdown system 40.

In an embodiment, control valve(s) 60 may be disposed downstream from blowdown drum 50 and upstream from heat exchanger(s) 70. In an embodiment, the flow of overhead vapors from blowdown drum 50 to heat exchanger(s) 70 may be controlled by control valve(s) 60. In an embodiment, control valve(s) 60 may be operated in either a normal mode or a back-pressure mode. In normal mode control valve(s) 60 may be more open (i.e., may have a higher % openness) than in back-pressure mode, and vice versa.

In an embodiment, control valve(s) 60 may be actuated, e.g., from normal mode to back-pressure mode, during the quench cycle to exert back pressure on vapor line 14, and to increase the coke drum internal pressure. In an embodiment, control valve(s) 60 may also be actuated, e.g., during a later stage of the quench cycle, to relieve back pressure on vapor line 14 and to decrease the coke drum internal pressure. Control valve(s) 60 are not limited to any particular type(s) of control valve(s).

In an embodiment, control valve(s) 60 may be actuated, e.g., partially closed, during the quench cycle so as to decrease the flow of overhead vapors from blowdown drum 50 and to exert back-pressure on vapor line 14. Unless otherwise specified, the terms "close," "closed," and the like, in relation to the actuation of control valve(s) 60 may be used herein to refer to decreasing the degree of openness of control valve(s) 60 (e.g., actuation from normal mode to back-pressure mode). Such decreased openness of control valve(s) 60 may result in increased vapor line pressure and increased coke drum internal pressure. Similarly, unless otherwise specified, the terms "open," "opened," and the like, in relation to the actuation of control valve(s) 60 may be used herein to refer to increasing the degree of openness of control valve(s) 60 (e.g., actuation from back-pressure mode to normal mode). Such increased openness of control valve(s) 60 may result in decreased vapor line pressure and decreased coke drum internal pressure.

Cooled vapors from heat exchanger 70 may be passed via a line 72 to separator 80 for the separation of water 81, a lighter oil fraction 82, and a gaseous fraction 83. Lighter oil fraction 82 may comprise condensable hydrocarbons. Gaseous fraction 83 may comprise non-condensable hydrocarbons and various gases, e.g., predominantly $C_1$-$C_3$ alkanes together with some $H_2S$ and $H_2$. In an embodiment, separator 80 may comprise a vapor-liquid separator or knockout drum. In an embodiment, blowdown system 40 may comprises two or more separators. As a non-limiting example, blowdown system 40 may comprise two or more separators arranged in series for the separation of water 81, the lighter oil fraction(s) 82, and the gaseous fraction 83.

As noted hereinabove, a delayed coker unit may include at least two coke drums, wherein each coke drum may alternately undergo a coking cycle and a decoking cycle (only one coke drum is shown in FIG. 1 for the sake of clarity of illustration). The decoking cycle includes a steam stripping step followed by a quench cycle or process. A coke drum quench cycle or process of the instant invention may itself comprise four steps or phases, namely i) an initial quench phase, ii) a ramp quench phase, iii) a pressure quench phase, and iv) a soak quench phase. These four phases are marked as QPI-QPIV, respectively, in FIG. 2.

The initial quench phase follows the steam stripping step, and involves feeding quench water to coke drum 10. The rate of feeding quench water to coke drum 10 may be referred to as the quench rate. The quench rate during the initial quench phase may be relatively low as compared with the ramp quench phase and the pressure quench phase. In an embodiment, the quench rate during the initial quench phase may be approximately constant. The quench rate during the initial quench phase may be referred to as the initial quench rate. Typically, the initial quench rate may be not more than about 400 gallons per minute (GPM), and often in the range from about 100 to 300 GPM. In an embodiment, the initial quench phase may have a duration in the range from about 20 to 60 minutes, or from about 30 to 55 minutes.

The ramp quench phase may follow the initial quench phase. The ramp quench phase may involve increasing the quench rate to coke drum 10. In an embodiment, at least part of the ramp quench phase may include a period of increasing the quench rate in a linear gradient. The maximum quench rate attained during the ramp quench phase may be referred to herein as the maximum ramp quench rate. The maximum ramp quench rate and the duration of the ramp quench phase may vary according to the size of the coke drum and the time available for the decoking cycle. In an embodiment, the quench rate may be increased during the ramp quench phase to about the maximum ramp quench rate and thereafter the ramp quench phase may include a period of time during which the quench rate may be held approximately constant.

The pressure quench phase may follow the ramp quench phase. In an embodiment, control valve(s) 60 may be actuated (e.g., partially closed) at the initiation of the pressure quench phase to effect an increase in pressure in vapor line 14 and coke drum 10. In an embodiment, actuation of control valve(s) 60 to effect an increase in vapor line pressure may mark the transition from the ramp quench phase to the pressure quench phase.

During the pressure quench phase, the quench rate to coke drum 10 may be further increased, e.g., increased to a level greater than the maximum ramp quench rate. The maximum quench rate attained during the pressure quench phase may be referred to as the maximum pressure quench rate. Typically, the maximum pressure quench rate may be in the range from about 1100 to 1800 GPM, and often in the range from about 1000 to 1700 GPM. In an embodiment, the pressure quench phase may have a duration in the range from about 55 to 75 minutes, or from about 55 to 70 minutes.

The soak quench phase may follow the pressure quench phase. At the onset of the soak quench phase, the quench rate to coke drum 10 may be rapidly decreased. The quench rate during the soak quench phase may be referred to as the soak quench rate. Typically, the soak quench rate may be in the range from about 0 to 100 GPM, or from about 0 to 75 GPM. In an embodiment, the soak quench phase may have a duration in the range from about 5 to 30 minutes, or from about 10 to 25 minutes. In an embodiment, the duration of the soak quench phase may be influenced by the amount of time available to complete the quench cycle, e.g., prior to the resumption of the coking cycle.

Figure 2:
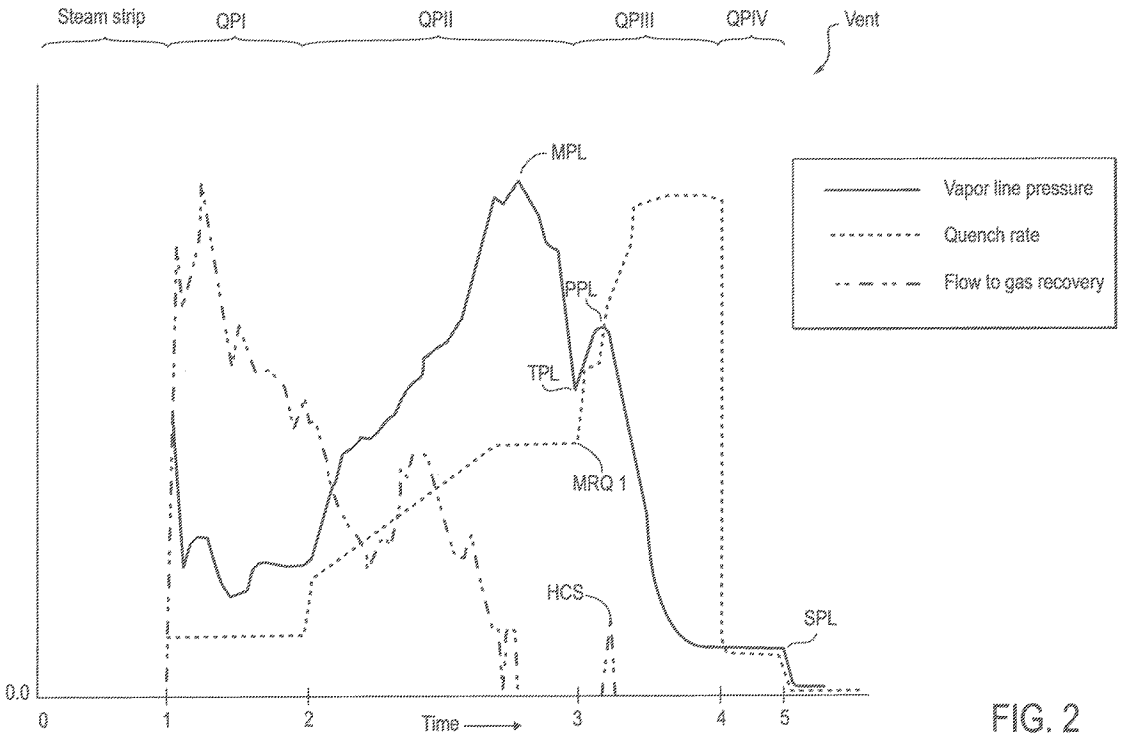
FIG. 2 represents quench rate, flow to gas recovery, and vapor line pressure during a coke drum quench process, according to an embodiment of the invention.

With further reference to the drawings, FIG. 2 represents quench rate, flow to gas recovery, and vapor line pressure during a coke drum quench process according to an embodiment of the invention. The ordinate for each of the quench rate, flow to gas recovery, and vapor line pressure is linear. The abscissa of FIG. 2 indicates time points (arbitrary units) that may be used to demarcate the various stages or phases of the decoking cycle. Time point 0 marks the switch from the coking cycle to the decoking cycle for a particular coke drum 10. In an embodiment, time point 0 may coincide with the initiation of steam stripping hydrocarbons from the coke. During the steam stripping process, vapors from coke drum 10 may be passed to main fractionator 20 via line 11.

The end of the steam stripping process may signal the onset of the quench cycle for quenching (cooling) the coke in coke drum 10. During the quench cycle, the vapors from coke drum 10 may be passed via vapor line 14 to blowdown system 40. The pressure in vapor line 14 may be referred to as the vapor line pressure. The vapor line pressure may be used as an indicator of the coke drum internal pressure during the quench process.

After the steam stripping process has been terminated, the quench cycle may begin at time point 1 with the initial quench phase, which is labeled as QPI in FIG. 2. During the initial quench phase, quench water may be fed to coke drum 10 at an initial quench rate. In an embodiment, the initial quench rate may be relatively low and fairly constant for the duration of the initial quench phase. During the initial quench phase most of the quench water fed to drum 10 may be vaporized, and the steam thus generated may remove hydrocarbons from the coke bed. The hot vapors, which may comprise steam as well as both condensable and non-condensable hydrocarbons, are passed from coke drum 10 via vapor line 14 to blowdown system 40 for the condensation of both water and oil as well as gas recovery. In an embodiment, the flow to gas recovery may peak during the initial quench phase, and thereafter the flow to gas recovery may cease, or decrease below detectable levels, prior to the pressure quench phase (see, FIG. 2).

After the initial quench phase the quench rate may be ramped up during the ramp quench phase, QPII, of the quench process. During the ramp quench phase, the quench rate may be increased either in a linear gradient, or in a step gradient, or by using a combination of the two. In an embodiment, the ramp quench phase may include a period during which the quench rate may be held constant or more or less constant. In an embodiment, the ramp quench phase may be held at least substantially constant after a maximum quench rate has been attained for the ramp quench phase. The maximum quench rate attained during the ramp quench phase may be referred to herein as the maximum ramp quench rate. In an embodiment, the maximum ramp quench rate may be at least about four times (4×) the initial quench rate.

With further reference to FIG. 2, during the ramp quench phase the vapor line pressure may increase to a maximum pressure level, MPL, and thereafter the vapor line pressure may decrease to a transitional pressure level, TPL. In an embodiment, the time at which the vapor line pressure falls to the transitional pressure level (i.e., time point 3 in FIG. 2) may coincide with the transition from the ramp quench phase to the pressure quench phase, QPIII. Prior to the pressure quench phase, the flow to gas recovery may cease or fall to zero, thereby indicating that a first portion of hydrocarbon vapors has been removed from the coke drum.

The phrase "first portion of hydrocarbon vapors" may be used herein to refer to all of the hydrocarbon vapors released (from coke drum 10) from the start of the initial quench phase until the flow to gas recovery falls to zero prior to the pressure quench phase. For the purpose of this disclosure, the flow to gas recovery may be considered to have fallen to zero when the flow to gas recovery falls below detectable levels using standard equipment known in the art.

In an embodiment, one or more control valves may be actuated, e.g., switched from a normal mode to a back-pressure mode, at the start of the pressure quench phase, QPIII. As an example, at the start of the pressure quench phase the degree of openness of the one or more control valves may be decreased. In an embodiment, such actuation of the one or more control valves may result in an increase in pressure from the transitional pressure level to a pulsed pressure level, PPL, e.g., as shown in FIG. 2.

After the pulsed pressure level has been attained, the one or more control valves may again be actuated, e.g., re-opened, or switched from back-pressure mode to normal mode, resulting in a further decrease in vapor line pressure. In an embodiment, the one or more control valves to be actuated during the pressure quench phase to effect either an increase or decrease in vapor line pressure may comprise control valve(s) 60 of blowdown system 40 (see, FIG. 1).

In an embodiment, during the pressure quench phase, the quench rate may be increased to a maximum quench rate of the pressure quench phase. The maximum quench rate attained during the pressure quench phase may be referred to herein as the maximum pressure quench rate. In an embodiment, the maximum pressure quench rate may be at least about 1.5 times (1.5×) the maximum ramp quench rate.

With still further reference to FIG. 2, time point 3 marks the beginning of the pressure quench phase. It can be seen from FIG. 2 that prior to, and at the beginning of, the pressure quench phase there is no measurable flow to gas recovery. Furthermore, there is no measurable flow to gas recovery until after the vapor line pressure has attained the pulsed pressure level. Then, shortly after the pulsed pressure level has been attained, there is a spike, HCS, in the flow to gas recovery due to the release of hydrocarbons from the coke drum. This spike in the flow to gas recovery represents the release of a second portion of hydrocarbons from the coke bed. This second portion of hydrocarbons, which is released from the coke bed during quenching processes of the invention, represents the "residual hydrocarbons" (as defined hereinabove) that would remain within the coke bed after the completion of a conventional coke drum quench process.

While not being bound by any theory, Applicant understands that the spike in flow to gas recovery may be due to the effect of "squeezing" quench water into previously inaccessible areas of the coke bed, via the pulsed vapor line pressure increase, to displace the residual hydrocarbons from the coke bed during the pressure quench phase of the quenching process of the instant invention. Applicant further understands that the release of this second portion of hydrocarbons from the coke bed (as the spike, HCS) greatly decreases the emissions of methane, ethane, and VOCs during venting the coke drum. In an embodiment, the spike (HCS) in flow to gas recovery is equivalent to a gas flow from each coke drum of approximately 0.33 million standard cubic feet per day (0.33 MMSCFD). In an embodiment, coke drum 10 may be vented via line 15 and a motor operated valve (MOV) (not shown in FIG. 1).

With still further reference to FIG. 2, during the pressure quench phase, the vapor line pressure may decrease from the pulsed pressure level to a soak pressure level, SPL. In an embodiment, the soak pressure level may be at least about 10 psig less than the pulsed pressure level. In an embodiment, the soak pressure level may be in the range from about 1 to 4 psig. In an embodiment, the soak pressure level may be not more than about 2 psig. In an embodiment, at the transition between the pressure quench phase and the soak quench phase, the quench rate may decrease several fold. As a non-limiting example, the soak quench rate may be in the range from about 0 to 100 GPM, or from about 0 to 75 GPM. The soak quench phase may have a duration in the range from about 5 to 30 minutes, or from about 10 to 25 minutes. After the soak quench phase, coke drum 10 may be vented at a vent pressure level. In an embodiment, the vent pressure level may be not more than about 2 psig.

Figure 3:
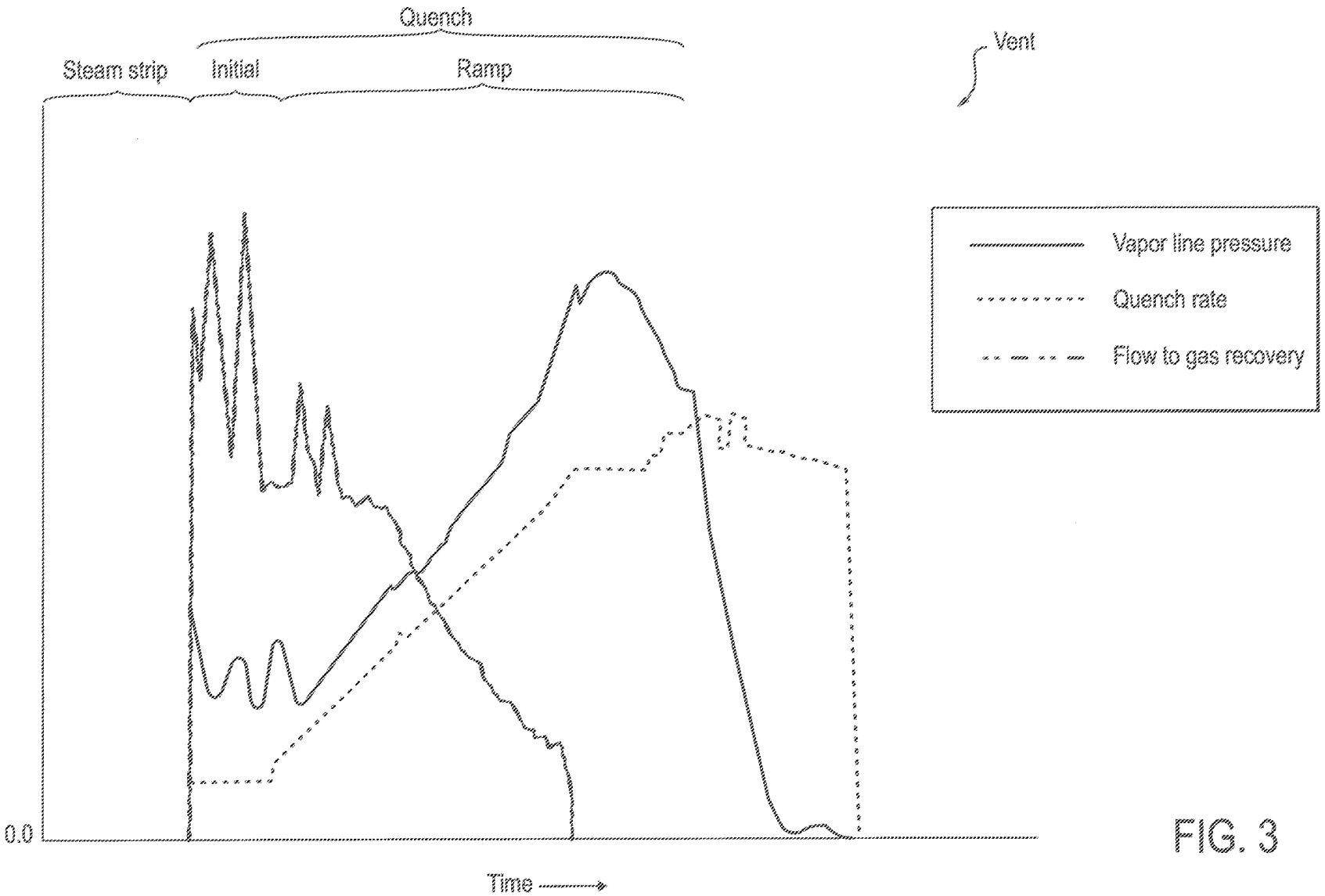
FIG. 3 represents quench rate, flow to gas recovery, and vapor line pressure during a conventional coke drum quench process, according to the prior art.

FIG. 3 represents quench rate, flow to gas recovery, and vapor line pressure during a conventional coke drum quench process. In the conventional process, after a relatively low initial quench rate, the rate is ramped up to a much higher level. However, in contrast to processes of the instant invention (see, e.g., FIG. 2), the conventional quenching process (FIG. 3) lacks a pressure quench phase. For example, in the prior art process there is no subsequent increase in vapor line pressure once the pressure begins to fall from the peak level. As a result, FIG. 3 does not show any further measurable flow to gas recovery after the flow has ceased or fallen to zero. Therefore, residual hydrocarbons remaining in the coke bed after completion of the prior art quench process are subsequently emitted from the coke drum when the drum is vented to the atmosphere.

As an example, the venting of each coke drum after prior art coke drum quenching may emit more than 17 lbs. of total VOCs, which is more than 17 times (17×) that from each coke drum quenched according to the invention (see, e.g., Examples 1 and 2 and Table 3). The peak pressure, peak quench rate, and total quench water usage for the prior art process of FIG. 3 were at least broadly similar to those for the process of FIG. 2.

In an embodiment of a process for quenching coke in a coke drum of a delayed coker unit, the process may comprise feeding quench water to the coke drum during an initial quench phase of the quenching process at an initial quench rate. Thereafter, the quenching process may comprise a step of increasing the rate of feeding the quench water to the coke drum during a ramp quench phase of the quenching process to attain a maximum ramp quench rate. During the ramp quench phase, the coke drum internal pressure may increase to a maximum pressure level and thereafter the coke drum internal pressure may decrease to a transitional pressure level.

The quenching process may also comprise a step of actuating at least one control valve, whereby the coke drum internal pressure may increase from the transitional pressure level to a pulsed pressure level. In an embodiment, the pulsed pressure level may be in the range from about 15 to 20 psig. The step of actuating the at least one control valve may be performed at the time when the pressure has decreased to the transitional pressure level.

After the ramp quench phase, the quenching process may also comprise a step of further increasing the rate of feeding the quench water to the coke drum during a pressure quench phase of the quenching process to attain a maximum pressure quench rate. In an embodiment, the maximum ramp quench rate may be at least about four times (4×) the initial quench rate, while the maximum pressure quench rate may be at least about 1.5 times (1.5×) the maximum ramp quench rate.

The recovery of hydrocarbon vapors from the coke may have ceased or decreased to zero prior to the step of actuating the at least one control valve. In an embodiment, the increase in the coke drum internal pressure to the pulsed pressure level effects the release of the residual hydrocarbons from the coke. Such release of the residual hydrocarbons from the coke corresponds to the second flow of hydrocarbon vapors from coke drum 10. The second flow of hydrocarbon vapors from the coke drum may be exhibited by the spike in flow to gas recovery (marked HCS in FIG. 2). The second flow of hydrocarbon vapors from the coke drum may occur after the step of actuating the at least one control valve to increase the coke drum internal pressure to the pulsed pressure level.

During the step of further increasing the rate of feeding the quench water to the coke drum during the pressure quench phase, the coke drum internal pressure may decrease from the pulsed pressure level to a soak pressure level. In an embodiment, the soak pressure level may be at least about 10 psig less than the pulsed pressure level. In an embodiment, the soak pressure level may be in the range from about 1 to 4 psig.

After the step of further increasing the rate of feeding the quench water to the coke drum during the pressure quench phase, the quenching process may comprise decreasing the rate of feeding the quench water to a soak quench rate during a soak quench phase of the quenching process. After the step of decreasing the rate of feeding the quench water to the soak quench rate, the coke drum may be vented to the atmosphere.

In another embodiment of a process for quenching coke in a coke drum of a delayed coker unit, the process may comprise feeding quench water to the coke during an initial quench phase. The quenching process may further comprise a step of increasing the rate of feeding the quench water to the coke drum during a ramp quench phase subsequent to the initial quench phase. During the ramp quench phase, the coke drum internal pressure may increase to a maximum pressure level and thereafter the coke drum internal pressure may decrease to a transitional pressure level.

The quenching process may further comprise, while the coke drum internal pressure is at the transitional pressure level, a step of actuating at least one control valve to effect an increase in the coke drum internal pressure to a pulsed pressure level, wherein the pulsed pressure level may be greater than the transitional pressure level. In an embodiment, the transitional pressure level may correspond to a trough of vapor line pressure at a time point marking the transition from the ramp quench phase to the pressure quench phase (see, e.g., FIG. 2).

After the step of actuating the at least one control valve to effect an increase in the coke drum internal pressure, the quenching process may further comprise actuating the at least one control valve to effect a decrease in the coke drum internal pressure from the pulsed pressure level to a vent pressure level.

After the step of actuating the at least one control valve to effect a decrease in the coke drum internal pressure, the quenching process may further comprise, soaking the coke in the quench water for a time period in the range from about 5 to 30 minutes prior to venting the coke drum. In an embodiment, the soaking step may be performed at a coke drum internal pressure in the range from about 1 to 4 psig. The soaking step may also be referred to herein as the soak quench phase (see, e.g., FIG. 2).

In an embodiment, the coke drum internal pressure may be in the range from about 2 to 10 psig during the initial quench phase, the maximum pressure level may be in the range from about 20 to 30 psig, the transitional pressure level may be in the range from about 10 to 20 psig, the pulsed pressure level may be in the range from about 15 to 20 psig, the soak pressure level may be in the range from about 1 to 4 psig, and the vent pressure level may be in the range from about 1 to 2 psig.

In an embodiment, the transitional pressure level may be at least about 5 psig less than the maximum pressure level. In an embodiment, the pulsed pressure level may be in the range from about 2 to 10 psig greater than the transitional pressure level. In an embodiment, the pulsed pressure level may be at least about 10 psig greater than the vent pressure level.

Prior to the step of actuating the at least one control valve to effect an increase in the coke drum internal pressure, a first flow of hydrocarbon vapors from the coke drum may have ceased or decreased to zero. After the step of actuating the at least one control valve to effect an increase in the coke drum internal pressure, the residual hydrocarbons that were previously trapped in the coke bed may be released from the coke bed to provide a second flow of hydrocarbon vapors from the coke drum. By purging the residual hydrocarbons from the coke drum during the quench cycle (i.e., prior to venting the drum), emissions from the coke drum during drum venting may be decreased by more than one order of magnitude.

In a further embodiment of a process for quenching coke in a coke drum of a delayed coker unit, the process may comprise feeding quench water to the coke drum to effect cooling of the coke. Typically, steam is generated when the quench water contacts the hot coke in the unquenched drum, the steam rises to the top of the drum together with residual hydrocarbon vapors from the coke, and the combined vapors exit coke drum 10 via line 54 en route to blowdown system 40.

Accordingly, the quenching process may further comprise, during the step of feeding quench water to coke drum 10, removing a first portion of hydrocarbon vapors from coke drum 10 to blowdown system 40. In an embodiment, the removal of the first portion of hydrocarbon vapors from coke drum 10 to blowdown system 40 may be continued until a first flow of hydrocarbon vapors from the coke drum has ceased or decreased to zero.

The phrase "first portion of hydrocarbon vapors" may be used herein to refer to all of the vapors released during the quench process until the time when the flow to gas recovery falls to zero, i.e., at a time prior to the pressure quench phase of the quench cycle, as shown in FIG. 2. The start of the pressure quench phase is marked at time point 3 in FIG. 2. It can be seen from FIG. 2 that at time point 3 there is no discernible flow to gas recovery, indicating that the first flow of hydrocarbon vapors from the coke drum has ceased or decreased to zero.

During the step of feeding quench water to the coke drum, the quenching process may further comprise actuating at least one control valve to effect an increase in coke drum internal pressure. The quenching process may further comprise releasing a second portion of hydrocarbon vapors from the coke bed via the increase in coke drum internal pressure. After the step of actuating at least one control valve to effect an increase in coke drum internal pressure, the quenching process may further comprise actuating at least one control valve to effect a decrease in coke drum internal pressure. In an embodiment, the control valve(s) that are actuated to decrease the coke drum internal pressure may be the same as the control valve(s) that are actuated to increase the coke drum internal pressure. The quenching process may further comprise recovering the second portion of hydrocarbon vapors from coke drum 10 via blowdown system 40.

Prior to the step of actuating the at least one control valve to effect an increase in coke drum internal pressure, the second portion of hydrocarbon vapors may be trapped in the coke. The step of actuating the at least one control valve to effect an increase in coke drum internal pressure may induce a spike in the release of the residual hydrocarbon vapors to blowdown system 40. In an embodiment, actuation of the at least one control valve to effect an increase in coke drum internal pressure may be performed after the first portion of hydrocarbon vapors has been removed from coke drum 10 to blowdown system 40 and the first flow of hydrocarbon vapors from the coke drum has ceased or decreased to zero. The second portion of hydrocarbon vapors released from the coke may be purged from the coke drum during the quenching process, i.e., prior to venting the coke drum to the atmosphere.

In an embodiment the increase in coke drum internal pressure, effected by actuation of the at least one control valve, may comprise an increase from a transitional pressure level to a pulsed pressure level. The pulsed pressure level may be in the range from about 2 to 10 psig greater than the transitional pressure level, or from about 2.5 to 8 psig greater than the transitional pressure level. In an embodiment, the increase in coke drum internal pressure from the transitional pressure level to the pulsed pressure level may occur over a time period in the range from about 2 to 20 minutes, or from about 4 to 15 minutes. In an embodiment, the increase in coke drum internal pressure from the transitional pressure level to the pulsed pressure level may occur at a rate in the range from about 0.1 to 1.0 psig per minute, or from about 0.2 to 0.8 psig per minute.

After the step of recovering the second portion of hydrocarbon vapors from the coke drum, the coke drum may be vented to the atmosphere. In an embodiment, the venting step may be performed at a coke drum internal pressure of not more than about 2 psig. In an embodiment, the venting step may comprise venting the coke drum to the atmosphere for a time period (vent duration) of less than 10 minutes, or less than five (<5) minutes, or less than two (<2) minutes, wherein the end of the vent period may be defined as the earliest time at which there is no measurable flow from the vented drum. In contrast to the invention, a coke drum that has been quenched using conventional quenching processes may require more than one hour (>1 hr.) to vent.

While not being bound by theory, Applicant believes that, in prior art quenching processes, inadequate cooling of the coke bed may cause some steam to be generated during the venting step; whereas in quenching processes of the invention, the coke bed is adequately cooled so as to prevent steam generation during drum venting. By eliminating the generation of steam during drum venting, according to an embodiment of the invention, the coke drum pressure can fall more rapidly thereby decreasing the vent duration.

During the venting step, the emission of each of methane, ethane, and total volatile organic compounds (total VOCs) from the coke drum may be much less than from drums quenched using conventional processes. The term "total VOCs" as used herein excludes both methane and ethane.

In an embodiment, the initial quench phase may have a duration in the range from about 30 to 60 minutes, or from about 35 to 55 minutes. In an embodiment, the ramp quench phase may have a duration in the range from about 85 to 125 minutes, or from about 90 to 120 minutes. In an embodiment, the pressure quench phase may have a duration in the range from about 55 to 75 minutes, or from about 55 to 70 minutes. In an embodiment, the soak quench phase may have a duration in the range from about 5 to 30 minutes, or from about 10 to 25 minutes.

In an embodiment, the initial quench rate may be not more than about 200 gallons per minute (GPM), and often in the range from about 100 to 200 GPM. The maximum ramp quench rate during the ramp quench phase may be in the range from about 500 to 1000 GPM, or from about 600 to 900 GPM. The maximum pressure quench rate during the pressure quench phase may be in the range from about 1100 to 1800 GPM, or from about 900 to 1600 GPM. The soak quench rate may be in the range from about 0 to 100 GPM, or from about 0 to 75 GPM.

EXAMPLES

The following Examples illustrate, but do not limit, the invention.

Example 1 (Comparative): Venting and Emissions Parameters for Coke Drums Quenched According to a Conventional Quenching Process After quenching each of six coke drums of a delayed coker unit according to a conventional quenching process that lacks a pressure quench phase (see, e.g., FIG. 3), the pressure in each of the six drums was reduced to a (starting) vent pressure of not more than 2 psig prior to venting the drums. The end of the vent duration was defined as the earliest time with no measurable flow from the vented drum. The vent pressure and vent duration for each drum was recorded and the data are shown in Table 1. Emissions of methane, ethane, and total VOCs were also measured separately during the venting process for each of the drums, and the data is presented in Table 2 ($C_1$-$C_2$) and Table 3 (total VOCs).

Example 2: Venting and Emissions Parameters for Coke Drums Quenched According to a Quenching Process of the Invention After quenching each of the same six coke drums (as in Example 1) using a quenching process comprising a pressure quench phase according to the invention (see, e.g., FIG.

2), the pressure in each of the six drums was reduced to a (starting) vent pressure of not more than 2 psig prior to venting the drums. The end of the vent duration was defined as the earliest time with no measurable flow from the vented drum. The vent pressure and vent duration for each drum was recorded and the data are shown in Table 1 for comparison with the data from Example 1. Emissions of methane, ethane, and total VOCs were also measured separately during the venting process for each of the drums, and the data is presented in Table 2 ($C_1$-$C_2$) and Table 3 (total VOCs).

TABLE 1

Coke drum vent pressure and vent duration for Examples 1 and 2

| | Vent pressure (psig) | | Vent duration (minutes) | |
|---|---|---|---|---|
| Drum No. | Example 1 | Example 2 | Example 1 | Example 2 |
| 1 | <2 | 1.5 | 7 | 1.6 |
| 2 | <2 | 1.9 | 61 | 6.0 |
| 3 | <2 | 1.5 | 5 | 1.5 |
| 4 | 0.8 | 0.8 | 61 | 1.5 |
| 5 | * | 1.7 | 16 | 1.0 |
| 6 | 0.3 | 1.9 | 62 | 5.0 |

* = no data

It can be seen from Examples 1 and 2 and Table 1 that quenching the coke drums according to the invention allows for the venting of each coke drum to be completed, on average, in a much shorter time period as compared with the conventional quenching process. It can also be seen that vent duration for coke drums quenched according to Example 1 (prior art) are highly variable. In contrast, the vent duration data for Example 2 (invention) are much more consistent.

TABLE 2

Coke drum emissions of methane and ethane for Examples 1 and 2

| Drum | Methane emissions (lbs.) | | Ethane emissions (lbs.) | |
|---|---|---|---|---|
| No. | Example 1 | Example 2 | Example 1 | Example 2 |
| 1 | 14.637 | 0.111 | 7.361 | 0.040 |
| 2 | 28.515 | 0.032 | 15.276 | 0.013 |
| 3 | 10.037 | 0.717 | 7.786 | 0.510 |
| 4 | 54.317 | 0.093 | 28.111 | 0.125 |
| 5 | 19.131 | 0.596 | 13.822 | 0.392 |
| 6 | 22.739 | 1.594 | 17.122 | 0.621 |

TABLE 3

Coke drum emissions of total VOCs for Examples 1 and 2

| Drum | Total VOCs emissions[1] (lbs.) | |
|---|---|---|
| No. | Example 1 | Example 2 |
| 1 | 17.722 | 0.031 |
| 2 | 4.524 | 0.106 |
| 3 | 3.233 | 0.521 |
| 4 | 8.469 | 0.385 |
| 5 | 10.053 | 0.590 |
| 6 | 7.853 | 0.218 |

[1]excludes methane and ethane

It can also be seen from Examples 1 and 2 and Tables 2 and 3 that the quenching process according to the invention results in much lower emissions of each of methane, ethane, and total VOCs during the venting of each coke drum, as compared with the conventional quenching process.

Numerous variations of the present invention may be possible in light of the teachings and examples herein. It is therefore understood that within the scope of the following claims, the invention may be practiced otherwise than as specifically described or exemplified herein.

What is claimed is:

1. A process for quenching coke in a coke drum of a delayed coker unit, the process comprising:

a) feeding quench water to the coke drum during an initial quench phase of the quenching process at an initial quench rate;

b) after step a), increasing the rate of feeding the quench water to the coke drum during a ramp quench phase of the quenching process to attain a maximum ramp quench rate, wherein during the ramp quench phase the coke drum internal pressure increases to a maximum pressure level and thereafter the coke drum internal pressure decreases to a transitional pressure level; and c) at the time of the transitional pressure level, actuating at least one control valve in a blowdown system that receives overhead vapors from the coke drum, whereby the coke drum internal pressure increases from the transitional pressure level to a pulsed pressure level.

2. The process of claim 1, wherein the pulsed pressure level is in the range from about 15 to 20 psig.

3. The process of claim 1, further comprising:

d) during step a), recovering hydrocarbon vapors from the coke, wherein:

prior to step c) the recovery of hydrocarbon vapors from the coke has decreased, and after step c) the increase in the coke drum internal pressure to the pulsed pressure level effects the release of residual hydrocarbons from the coke.

4. The process of claim 3, wherein: prior to step c) the recovery of hydrocarbon vapors from the coke has decreased to zero.

5. The process of claim 1, further comprising:

e) after actuating the at least one control valve to start a pressure quench phase of the quenching process, further increasing the rate of feeding the quench water to the coke drum during the pressure quench phase of the quenching process to attain a maximum pressure quench rate, wherein the maximum pressure quench rate is at least about 1.5 times (1.5×) the maximum ramp quench rate.

6. The process of claim 1, further comprising:

f) after step c), actuating the at least one control valve to effect a decrease in the coke drum internal pressure from the pulsed pressure level to a vent pressure level; and g) venting the coke drum to the atmosphere.

7. A process for quenching coke in a coke drum of a delayed coker unit, the process comprising:

a) feeding quench water to the coke drum during an initial quench phase;

b) increasing the rate of feeding the quench water to the coke drum during a ramp quench phase subsequent to the initial quench phase, wherein during the ramp quench phase the coke drum internal pressure increases to a maximum pressure level and thereafter the coke drum internal pressure decreases to a transitional pressure level;

c) while the coke drum internal pressure is at the transitional pressure level, actuating at least one control valve, in a blowdown system that receives overhead vapors from the coke drum, to effect an increase in the coke drum internal pressure to a pulsed pressure level greater than the transitional pressure level; and d) after step c), actuating the at least one control valve to effect a decrease in the coke drum internal pressure from the pulsed pressure level to a vent pressure level.

8. The process of claim 7, wherein during the initial quench phase the coke drum internal pressure is in the range from about 2 to 10 psig, and the maximum pressure level is in the range from about 20 to 30 psig.

9. The process of claim 8, wherein the transitional pressure level is in the range from about 10 to 20 psig.

10. The process of claim 9, wherein the pulsed pressure level is in the range from about 15 to 20 psig.

11. The process of claim 9, wherein the pulsed pressure level is in the range from about 2 to 10 psig greater than the transitional pressure level.

12. The process of claim 7, further comprising:

e) after step d) and prior to venting the coke drum, soaking the coke in the quench water for a time period in the range from about 5 to 30 minutes at a coke drum internal pressure in the range from about 1 to 4 psig.

13. The process of claim 7, wherein:

prior to step c) a first flow of hydrocarbon vapors from the coke drum has decreased, and after step c) residual hydrocarbons are released from the coke to provide a second flow of hydrocarbon vapors from the coke drum.

14. The process of claim 13, wherein: prior to step c) the first flow of hydrocarbon vapors from the coke drum has decreased to zero.

15. A process for quenching coke in a coke drum of a delayed coker unit having a blowdown system, the process comprising:

a) feeding quench water to the coke drum to effect cooling of the coke;

b) during step a), removing a first portion of hydrocarbon vapors from the coke drum to the blowdown system until a first flow of hydrocarbon vapors from the coke drum has decreased;

c) during step a), actuating at least one control valve in the blowdown system to effect an increase in coke drum internal pressure;

d) releasing a second portion of hydrocarbon vapors from the coke via the increase in coke drum internal pressure;

e) after step c), actuating the at least one control valve to effect a decrease in coke drum internal pressure; and f) recovering the second portion of hydrocarbon vapors from the coke drum.

16. The process of claim 15, wherein prior to step c) the second portion of hydrocarbon vapors are trapped in the coke.

17. The process of claim 15, wherein step c) is performed after step b).

18. The process of claim 15, wherein:

the increase in coke drum internal pressure effected by step c) comprises an increase from a transitional pressure level to a pulsed pressure level, and the increase in coke drum internal pressure from the transitional pressure level to the pulsed pressure level occurs over a time period in the range from about 2 to 20 minutes.

19. The process of claim 15, further comprising:

g) after step f), venting the coke drum to the atmosphere at a coke drum internal pressure of not more than about 2 psig.

20. The process of claim 19, wherein step g) comprises venting the coke drum to the atmosphere for a time period of less than 10 minutes.

21. The process of claim 15, wherein the blowdown system comprises a blowdown drum, and the at least one control valve is disposed downstream from the blowdown drum.

22. The process of claim 21, wherein the blowdown system further comprises at least one heat exchanger disposed downstream from the blowdown drum, and the at least one control valve is disposed upstream from the at least one heat exchanger.

23. The process of claim 15, wherein: during step b) the first flow of hydrocarbon vapors from the coke drum has decreased to zero.

* * * * *